US011112158B2

(12) United States Patent
Pfeiffer et al.

(10) Patent No.: US 11,112,158 B2
(45) Date of Patent: Sep. 7, 2021

(54) REFRIGERATION APPLIANCE WITH WATER SUPPLY

(71) Applicant: BSH HAUSGERAETE GMBH, Munich (DE)

(72) Inventors: Klaus Pfeiffer, Heidenheim (DE); Karl-Friedrich Laible, Langenau (DE); Eugen Gaplikow, Bubesheim (DE)

(73) Assignee: BSH Hausgeraete GmbH, Munich (DE)

( * ) Notice: Subject to any disclaimer, the term of this patent is extended or adjusted under 35 U.S.C. 154(b) by 95 days.

(21) Appl. No.: 16/445,794

(22) Filed: Jun. 19, 2019

(65) Prior Publication Data

US 2019/0301782 A1 Oct. 3, 2019

Related U.S. Application Data

(63) Continuation of application No. 15/353,010, filed on Nov. 16, 2016, now abandoned.

(30) Foreign Application Priority Data

Nov. 18, 2015 (DE) ..... 10 2015 222 731.6

(51) Int. Cl.
*F25C 1/25* (2018.01)
*F25D 23/06* (2006.01)

(52) U.S. Cl.
CPC ..... *F25C 1/25* (2018.01); *F25D 23/068* (2013.01); *F25C 2400/14* (2013.01); *F25C 2500/08* (2013.01)

(58) Field of Classification Search
CPC .. F25C 1/225; F25C 2400/14; F25C 2500/08; F25C 1/25; F25D 23/068
See application file for complete search history.

(56) References Cited

U.S. PATENT DOCUMENTS

| | | | | | |
|---|---|---|---|---|---|
| 2,770,102 | A | * | 11/1956 | Roedter | F25C 1/04 62/137 |
| 3,012,417 | A | * | 12/1961 | Harle | F25C 1/25 62/347 |
| 3,226,939 | A | * | 1/1966 | Harbison | F25C 5/18 62/177 |
| 3,298,189 | A | * | 1/1967 | Beck | F25C 1/04 62/135 |
| 3,366,404 | A | * | 1/1968 | Lloyd | F16L 27/107 285/8 |
| 3,835,661 | A | | 9/1974 | Kochendorfer et al. | |
| 4,020,644 | A | | 5/1977 | True, Jr. | F25D 23/061 62/340 |
| 4,217,762 | A | | 8/1980 | Sakamoto | F25C 1/04 62/132 |

(Continued)

FOREIGN PATENT DOCUMENTS

| | | | |
|---|---|---|---|
| FR | 2523281 | A1 | 9/1983 |
| GB | 2118700 | A | 11/1983 |
| WO | 2014090608 | A1 | 6/2014 |

*Primary Examiner* — Kun Kai Ma
(74) *Attorney, Agent, or Firm* — Laurence A. Greenberg; Werner H. Sterner; Ralph E. Locher

(57) ABSTRACT

A refrigeration appliance, in particular a domestic refrigeration appliance, includes a storage chamber which can be cooled to below 0° C. A water supply feeding into the storage chamber is formed by a resiliently expandable pipeline, at least inside the storage chamber.

12 Claims, 2 Drawing Sheets

(56) References Cited

U.S. PATENT DOCUMENTS

| | | | | |
|---|---|---|---|---|
| 4,265,952 | A | 5/1981 | Caines | C04B 35/536 138/137 |
| 5,425,248 | A * | 6/1995 | Trantina | F25C 1/04 62/349 |
| 6,082,780 | A * | 7/2000 | Rowley | B29C 45/14336 264/271.1 |
| 6,148,624 | A | 11/2000 | Bishop | F25C 5/185 62/137 |
| 6,157,777 | A | 12/2000 | Banks | F24H 1/142 219/536 |
| 6,810,680 | B2 | 11/2004 | Pohl | F25C 1/04 62/420 |
| 2003/0101741 | A1 * | 6/2003 | Wiseman | F25C 5/22 62/347 |
| 2003/0213262 | A1 * | 11/2003 | Kang | F25C 1/04 62/347 |
| 2010/0024461 | A1 * | 2/2010 | Buchstab | F25C 5/22 62/320 |
| 2015/0300717 | A1 * | 10/2015 | Gaplikow | F25C 1/25 62/340 |

* cited by examiner

REFRIGERATION APPLIANCE WITH WATER SUPPLY

CROSS-REFERENCE TO RELATED APPLICATION

This application is a continuation of patent application Ser. No. 15/353,010, filed Nov. 16, 2016; which also claims the priority, under 35 U.S.C. § 119, of German patent application No. DE 10 2015 222 731.6, filed Nov. 18, 2015; the prior applications are herewith incorporated by reference in their entirety.

BACKGROUND OF THE INVENTION

Field of the Invention

The present invention relates to a refrigeration appliance, in particular a domestic refrigeration appliance, with a water supply, as described in International Publication WO 2014/090608 A1, corresponding to U.S. Patent Application US 2015/0300717, for example.

A water supply, which connects the refrigeration appliance to a building water connection, is required in particular when an automatic ice maker is to be operated in a storage chamber of the refrigeration appliance.

In the refrigeration appliance known from International Publication WO 2014/090608 A1, corresponding to U.S. Patent Application US 2015/0300717, a filling pipe, which forms a downstream end of the water supply, protrudes into the storage chamber and is exposed to temperatures below 0° C. there. If the filling pipe does not become completely empty after the ice maker is filled, that results in any water remaining therein possibly freezing. If that freezing water blocks the water supply, the ice production is disrupted.

In order to prevent such a blockage, the filling pipe can be electrically heated. However, that impairs the energy efficiency of the refrigeration appliance considerably, since on one hand energy has to be expended in order to keep the filling pipe frost-free, and on the other hand the compressor of the refrigeration appliance must run for a longer period, in order to bring the heat emitted by the heating of the filling pipe back out from the storage chamber again.

It has also been proposed to use ambient heat to keep the water supply ice-free. That enables the energy expended on operating the heating to be saved, but the increased heat supply to the storage chamber also leads to prolonged compressor running times and to a correspondingly higher energy consumption.

SUMMARY OF THE INVENTION

It is accordingly an object of the invention to provide a refrigeration appliance with a water supply, which overcomes the hereinafore-mentioned disadvantages of the heretofore-known appliances of this general type and in which it is ensured that the water supply is functional at all times, without the maintenance of the functionality impairing the energy efficiency of the appliance as a result.

With the foregoing and other objects in view there is provided, in accordance with the invention, a refrigeration appliance, in particular a domestic refrigeration appliance, comprising a storage chamber which can be cooled to below 0° C. and a water supply feeding into the storage chamber. The water supply is formed by a resiliently expandable pipeline inside the storage chamber. This does not preclude water, which remains in the pipeline after a filling process, from freezing therein and forming a plug of ice there. Due to the flexibility of the pipeline, however, liquid water fed into the water supply with sufficient pressure can expand the pipeline and thus either create a path past the plug, so that the plug is thawed by water flowing past, or push the plug out of the pipeline as a whole.

Usually the water supply is provided to supply an ice maker in the storage chamber with fresh water. However, in principle other consumers in the storage chamber can also be supplied through the water supply.

A stop valve should be provided in a frost-free section of the water supply, in order to not be impaired in its function by the formation of ice.

Preferably, the pipeline includes a hose made of a resilient rubber material. In principle, the pipeline could also be formed of an inflexible resilient material such as a thin metal sheet, but specific cross sectional shapes of the pipeline, such as a cross or star-shaped cross section, are then required in order to enable the cross sectional expansion to release the ice plug under pressure.

The water supply can be surrounded by a sleeve on at least one part of its length.

The sleeve can serve various purposes. Irrespective of which part of the pipeline it surrounds, the sleeve should be dimensioned in such a way that it inhibits an expansion of the pipeline beyond its resiliency limit.

One section of the pipeline, which protrudes into the storage chamber, can be stabilized by the sleeve, which in particular can be required if that section is formed of a slightly ductile material and could bend under the weight of the water contained therein. The sheathing provided by the sleeve can also serve as thermal insulation of the pipeline in this case and delay the freezing of the water following a filling process.

In particular, if the pipeline also extends outside the storage chamber, it is expedient to place a close limit on a possible expansion of the pipeline there by a sleeve surrounding it, preferably by the sleeve surrounding the pipeline outside the storage chamber with a close fit. Since many resilient materials are more yielding when warm than when cold, without such a limit there would be the risk of the warm part of the pipeline being stretched before the expansion at its cold end is sufficient to remove the ice plug, or the cold end remaining altogether unstretched and the ice plug remaining in place.

The sleeve and the pipeline can be extruded in one piece. The sleeve will then, as a rule, have a greater wall thickness than before, in order to effectively limit the expansion of the pipeline.

The pipeline can also, however, be inserted into the sleeve. This is particularly expedient if the sleeve should only surround the pipeline on one part of its length and/or if a different material is to be used for the sleeve than for the pipeline.

Expediently, the sleeve should separate the pipeline from an insulation material layer surrounding the storage chamber. Thus, a lasting deformation of the insulation material layer caused by repeated expansion of the pipeline, which would lead to a thermal bridge between the storage chamber and the surroundings, would be prevented.

At least in a region of the insulation material layer adjacent the storage chamber it is expedient if the sleeve surrounds the pipeline while retaining play. The pipeline thus, even within the insulation material layer, at a point up to which the ice plug does not reach, has room to expand, which considerably facilitates the spreading of the expansion past the plug toward the end of the pipeline.

Conversely, at least in a region of the insulation material layer facing away from the storage chamber it is expedient if the sleeve surrounds the pipeline without play. This minimizes the inflow of ambient heat to the storage chamber.

Since the resilient expansion is only beneficial for the removal of the ice plug if it takes place in the immediate surroundings, a downstream section of the water supply is preferably not resiliently expandable.

Other features which are considered as characteristic for the invention are set forth in the appended claims.

Although the invention is illustrated and described herein as embodied in a refrigeration appliance with a water supply, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
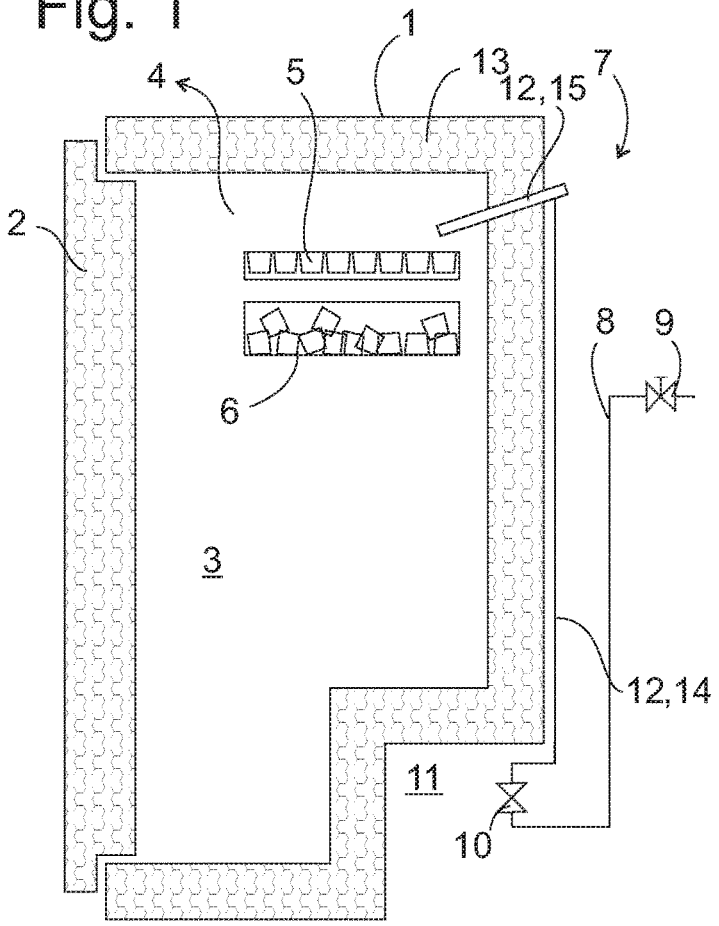
FIG. 1 is a diagrammatic, vertical-sectional view of a refrigeration appliance according to the invention.

Referring now to the figures of the drawings in detail and first, particularly, to FIG. 1 thereof, there is seen a cross-section through a domestic refrigeration appliance, in this case a freezer, with a body 1 and a door 2 hinged on the body 1, which surround a cooled storage chamber 3. An ice maker 4 is accommodated in the storage chamber 3. The ice maker 4 includes, in a manner known per se, a tray 5 with a plurality of ice cube molds, which can be pivoted between a freezing position, in which the ice cube molds open upward and can be filled with fresh water, and an ejection position, in which the ice cube molds are open downward, in order to dispense the finished ice cubes into a container 6 disposed below the tray 5.

The filling of the tray 5 with water is effected through a water supply 7. This water supply 7 includes a line, typically a pressure-proof, non-expandable hose 8, which extends from a building water faucet 9 to a stop valve 10. The stop valve 10 is accommodated in this case in a machine space 11 of the refrigeration appliance. The water supply 7 also includes a line 12 fitted in the refrigeration appliance in a fixed manner. The line 12 extends from the stop valve 10 through an insulation material layer 13 of the body 1 into the storage chamber 3 and ends above the tray 5. A majority of the line 12 runs outside the insulation material layer 13 protected from frost and is formed in this case by a rigid pipe 14, which cannot expand due to the pressure prevailing in the building's water line if the pressure acts in the pipe 14.

Figure 2A:
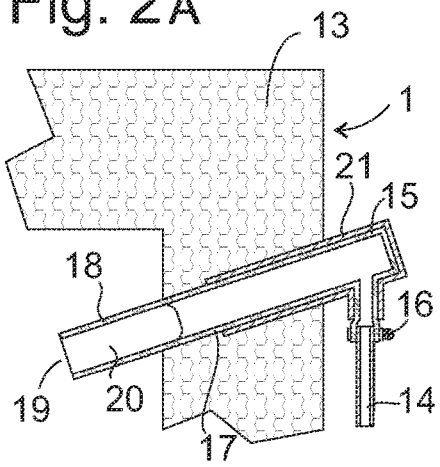
FIG. 2A is an enlarged, fragmentary, vertical-sectional view of the refrigeration appliance with a pipeline blocked by an ice plug.

As FIG. 2A shows in an enlarged detailed view, the pipe 14 ends shortly before the water supply 7 passes through the insulation material layer 13. A pipeline 15 made of a resilient rubber material is attached to the end of the pipe 14 and is secured by a clip 16 or the like. The pipeline 15 extends through the insulation material layer 13 and protrudes freely into the storage chamber 3, so that an outlet end 19 of the pipeline 15 lies over the tray 5, which is not shown in FIG. 2A.

The cross section of the pipeline 15, at least in a section 17 which extends through the insulation material layer 13 and in a section 18 protruding into the storage chamber 3, amounts to only a few millimeters, in order to minimize an inflow of ambient heat to the storage chamber 3 through the pipeline 15. This results in water regularly remaining in the pipeline 15 after the filling of the tray 5. The water freezes in the section 18 and there forms an ice plug 20 which blocks the pipeline 15 over the entire cross-section.

A rigid, non-expandable sleeve 21 surrounds a section of the pipeline 15 which lies outside the insulation material layer 13 and extends into the insulation material layer 13. The sleeve 21 has a close fit around the pipeline 15 and does not permit any significant expansion of the pipeline 15 under pressure.

Figure 2B:
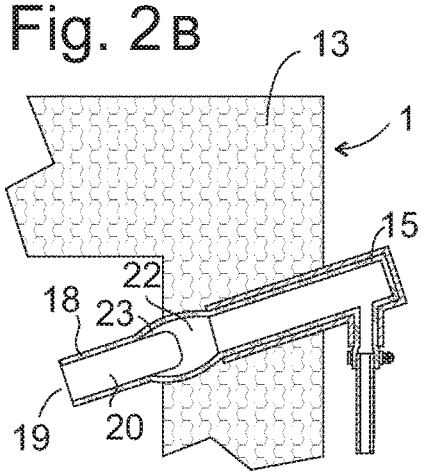
FIG. 2B is a view similar to FIG. 2A showing a situation in which an expansion of the pipeline is being implemented.
Figure 2C:
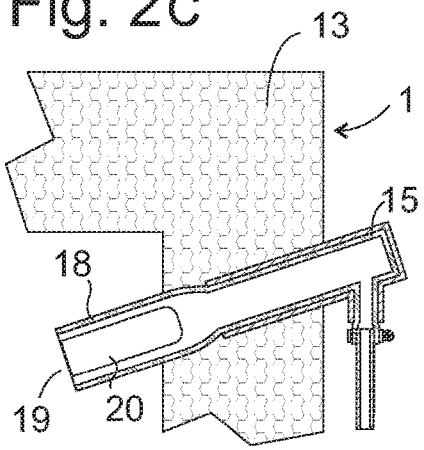
FIG. 2C is a view similar to FIG. 2A showing a situation in which the ice plug is being loosened.

In one part of the section 17 adjacent the storage chamber 3, the pipeline 15 is not surrounded by the sleeve 21. If the stop valve 10 is opened in order to let fresh water into the tray 5, but at the same time the pipeline 15 is blocked by the ice plug 20, the pressure of the domestic water line acts in the pipeline 15 and expands the pipeline 15 at a point 22, as shown in FIG. 2B. This also causes the wall of the pipeline 15 to raise away from the ice plug 20 and therefore liquid water can penetrate into the gap 23 forming around the downstream end of the ice plug 20. The gap 23 thus grows in length, and once it has reached the outlet end 19 of the pipeline 15 as shown in FIG. 2C, the ice plug 20 is pushed out under the pressure of the water and falls into the tray 5. The water supply 7 is now continuous and the tray 5 can be filled. During the filling, the expanded parts of the pipeline 15 contract again, so that if, after the filling, the water freezes again in the section 18, an ice plug 20 is formed with the same dimensions as before, which can be driven out by the expansion of the pipeline 15 once more.

Figure 3:
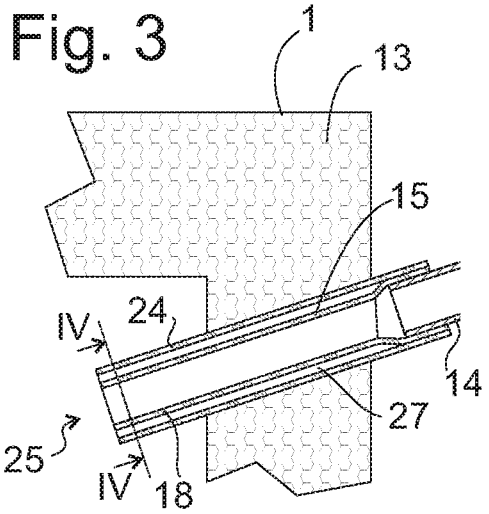
FIG. 3 is a vertical-sectional view similar to FIG. 2A in accordance with a modified embodiment.
Figure 4:
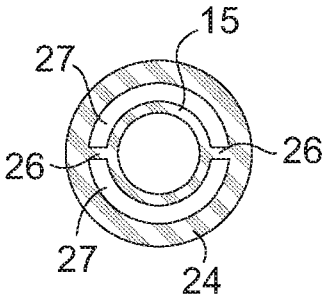
FIG. 4 is a cross-sectional view taken along a plane IV-IV of FIG. 3, in the direction of the arrows.

FIG. 3 is a section similar to FIG. 2A through a corner of the body 1 showing the pipeline 15 extending through the insulation material layer 13 in accordance with a second embodiment of the invention. FIG. 4 shows a cross-section through the pipeline 15 which is taken along a plane IV-IV of FIG. 3. The pipeline 15 is manufactured in this case together with a sleeve 24 surrounding it as an extruded profile 25. The pipeline 15 has walls thin enough to be resiliently expandable under pressure. The sleeve 24 is rigid and not significantly expandable due to its greater wall thickness. The sleeve 24 protects the section 18 of the pipeline 15 protruding into the storage chamber 3 from inadvertent bending, which could lead to water from the pipeline 15 not reaching the tray 5.

The pipeline 15 and the sleeve 24 are connected through webs 26 over their entire length. The webs 26 are thin-walled like the pipeline 15 and are able to yield to an expansion of the pipeline 15. The webs 26 can extend in a straight line in the axial direction of the extruded profile 25, but they can also run in a spiral manner around the pipeline 15. In the latter case, a single web 26 can be sufficient to hold the pipeline 15 centered in the sleeve 21.

The diameter of the sleeve 24 is expediently dimensioned in this case in such a way that the sleeve 24 inhibits an expansion of the pipeline 15 beyond its resiliency limit. A local overstraining of the pipeline 15, which over time would lead to the pipeline 15 bursting, can also be reliably prevented with a low wall thickness of the pipeline 15.

As in the first embodiment, the pipeline 15 is connected to the stop valve 10 through a rigid pipe 14. The rigid pipe 14 is inserted into the pipeline 15 at an end of the extruded profile 25 protruding from the body 1. The diameter of the rigid pipe 14 is chosen in such a way that the pipeline 15 is pressed onto the sleeve 24 from inside. An intermediate space 27 between the pipeline 15 and the sleeve 24 is thus tightly sealed off from the outside, and an inflow of warm ambient air through the intermediate space 27 into the storage chamber 3 is prohibited. If the webs 26 run in a spiral manner around the pipeline 15, as described above, the transport of heat by air circulation between a warm and a cold end of the intermediate space 27 can also be effectively prevented thereby.

The operation of this embodiment corresponds to that described with reference to FIGS. 2A-C: If an ice plug forms at the end of the pipeline 15, then the pressure in the pipeline 15 increases with the opening of the stop valve 10 and the pipeline 15 expands until it is prevented from expanding further by the sleeve 24. Through the use of this expansion, water can penetrate between the ice plug and the part of the pipeline 15 surrounding it and can loosen the ice plug.

Figure 5:
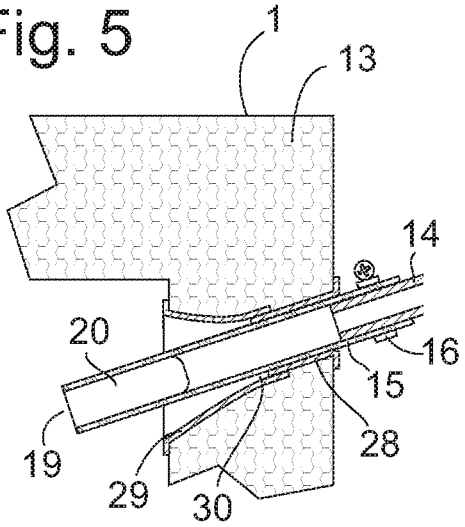
FIG. 5 is another vertical-sectional view similar to FIG. 2A in accordance with a further modified embodiment.

The embodiment of FIG. 5 corresponds to that of FIGS. 2A-C in that the expandable pipeline 15 is surrounded outside the insulation material layer 13 and on a part of its path through the insulation material layer 13 by a non-expandable sleeve 28 with a tight fit, which protrudes from the outside into the insulation material layer 13. The pipeline 15 is a piece of a rubber or silicone hose, which is fastened at the end of a rigid line 14 coming from the stop valve 10 and is inserted into the sleeve 28. The sleeve 28 is in turn plugged tightly into a sleeve 29 engaging from the storage chamber 3 into the insulation material layer 13 and against the insulation material of the layer 13. The diameter of the sleeve 29 is larger than that of the sleeve 17 and it accordingly receives the pipeline 15 while retaining play to allow an expansion of the pipeline 15 under pressure, as opposed to sleeve 17. The length and diameter of the sleeve 29 are dimensioned in such a way that at an end 30 of the sleeve 29 facing away from the storage chamber the temperature is constantly above 0° C., so that the ice plug 20 never expands beyond the entire length of the sleeve 29. Thus, at the end 30, an expansion can constantly form in the pipeline 15 upstream of the ice plug 20 and grow towards the outlet end 19 which loosens the ice plug 20.

The invention claimed is:

1. A refrigeration appliance or domestic refrigeration appliance, comprising:

a storage chamber to be cooled to below 0° C.; and a water supply feeding into said storage chamber, said water supply being formed by a resiliently expandable pipeline, at least inside said storage chamber, said resiliently expandable pipeline having a length, and a sleeve surrounding at least a part of said length of said resiliently expandable pipeline, said resiliently expandable pipeline having a resiliency limit, and said sleeve being dimensioned for inhibiting an expansion of said resiliently expandable pipeline beyond said resiliency limit, said sleeve and said resiliently expandable pipeline being formed in one piece; and at least one web interconnecting said sleeve and said resiliently expandable pipeline.

2. The refrigeration appliance according to claim 1, which further comprises an ice maker disposed in said storage chamber and fed by said water supply.

3. The refrigeration appliance according to claim 1, wherein said water supply has a frost-free section, and a stop valve is disposed in said frost-free section.

4. The refrigeration appliance according to claim 1, wherein said resiliently expandable pipeline includes a resilient rubber hose.

5. The refrigeration appliance according to claim 1, wherein said resiliently expandable pipeline has a section protruding into said storage chamber, and said sleeve surrounds said section of said resiliently expandable pipeline protruding into said storage chamber.

6. The refrigeration appliance according to claim 1, wherein said sleeve closely surrounds said resiliently expandable pipeline outside said storage chamber.

7. The refrigeration appliance according to claim 1, which further comprises an insulation material layer surrounding said storage chamber, said sleeve separating said resiliently expandable pipeline from said insulation material layer.

8. The refrigeration appliance according to claim 7, wherein said insulation material layer has a region adjacent said storage chamber, and said sleeve surrounds said resiliently expandable pipeline while retaining play at least in said region of said insulation material layer adjacent said storage chamber.

9. The refrigeration appliance according to claim 8, wherein said insulation material layer has a region facing away from said storage chamber, and said sleeve surrounds said resiliently expandable pipeline without play at least in said region of said insulation material layer facing away from said storage chamber.

10. The refrigeration appliance according to claim 1, wherein said water supply has an upstream section not being resiliently expandable.

11. A refrigeration appliance or domestic refrigeration appliance, comprising:

a storage chamber to be cooled to below 0° C.;

a water supply feeding into said storage chamber, said water supply being formed by a resiliently expandable pipeline, at least inside said storage chamber, said resiliently expandable pipeline having a length, and a sleeve surrounding at least a part of said length of said resiliently expandable pipeline, said resiliently expandable pipeline having a resiliency limit, and said sleeve being dimensioned for inhibiting an expansion of said resiliently expandable pipeline beyond said resiliency limit, said sleeve and said resiliently expandable pipeline being formed in one piece; and an insulation material layer surrounding said storage chamber, said sleeve separating said resiliently expandable pipeline from said insulation material layer, said insulation material layer having a region facing away from said storage chamber, and said sleeve surrounding said resiliently expandable pipeline without play at least in said region of said insulation material layer facing away from said storage chamber.

12. A refrigeration appliance or domestic refrigeration appliance, comprising:

a storage chamber to be cooled to below 0° C.; and a water supply feeding into said storage chamber, said water supply being formed by a resiliently expandable pipeline, at least inside said storage chamber, said resiliently expandable pipeline having a length, and a sleeve surrounding at least a part of said length of said resiliently expandable pipeline, said resiliently expandable pipeline having a resiliency limit, and said sleeve being dimensioned for inhibiting an expansion of said resiliently expandable pipeline beyond said resiliency limit, said sleeve and said resiliently expandable pipeline being formed in one piece, said sleeve and said resiliently expandable pipeline being extruded.

* * * * *